US009664355B2

(12) United States Patent
Tseng et al.

(10) Patent No.: US 9,664,355 B2
(45) Date of Patent: May 30, 2017

(54) LED LAMP WITH EXTERNAL LIGHT SOURCE

(71) Applicant: Kaistar Lighting (Xiamen) Co.,ltd, Xiamen (CN)

(72) Inventors: Chih Min Tseng, Xiamen (CN); Yung-Yi Chuang, Xiamen (CN)

(73) Assignee: Kaistar Lighting (Xiamen) Co., ltd, Xiamen (CN)

( * ) Notice: Subject to any disclaimer, the term of this patent is extended or adjusted under 35 U.S.C. 154(b) by 0 days.

(21) Appl. No.: 14/882,421

(22) Filed: Oct. 13, 2015

(65) Prior Publication Data

US 2016/0230940 A1 Aug. 11, 2016

(30) Foreign Application Priority Data

Feb. 6, 2015 (CN) ..... 2015 1 0062164

(51) Int. Cl.

| | |
|---|---|
| ***F21V 3/04*** | (2006.01) |
| ***F21K 9/66*** | (2016.01) |
| *F21V 19/00* | (2006.01) |
| *F21K 9/27* | (2016.01) |
| *F21Y 103/10* | (2016.01) |
| *F21Y 115/10* | (2016.01) |

(52) U.S. Cl.

CPC ..... *F21V 3/0418* (2013.01); *F21K 9/66* (2016.08); *F21K 9/27* (2016.08); *F21V 3/0472* (2013.01); *F21V 19/005* (2013.01); *F21Y 2103/10* (2016.08); *F21Y 2115/10* (2016.08)

(58) Field of Classification Search

CPC ... F21V 29/70; F21V 3/04; F21V 5/04; F21V 5/043; F21V 3/0418; F21V 3/0472; F21V 19/005; F21K 9/66; F21K 9/27; F21K 9/17; F21Y 2103/10; F21Y 2115/10; F21Y 2101/00; F21S 4/28

USPC ..... 362/218, 219, 222, 223, 225

See application file for complete search history.

(56) References Cited

U.S. PATENT DOCUMENTS 6,874,924 B1 * 4/2005 Hulse ..... G02B 6/0001 362/219
8,272,764 B2 * 9/2012 Son ..... F21V 3/02 315/152

(Continued)

FOREIGN PATENT DOCUMENTS

CN 201373341 Y 12/2009
CN 201615377 U 10/2010

(Continued)

*Primary Examiner* — Laura Tso
(74) *Attorney, Agent, or Firm* — Hemisphere Law, PLLC

(57) ABSTRACT

This invention discloses an LED lamp with an external light source, including a tube, an LED light source plate. The LED light source plate includes a strip base and a plurality of LED illuminants. The lamp has a strip through hole along the length direction of the lamp. The strip base is fixed to the external circumference surface of the lamp, the plurality of LED illuminants are placed between the two side surfaces of the strip through hole. Preferably, the lamp is a circular glass lamp, the strip through hole is on the top of the lamp. Furthermore, the inner surface of the lamp is covered with a diffusion layer. The present invention is beneficial for automatic production and reducing the cost. At the same time, the LED light has a good diffusion and the waste heat is easy to dissipate.

5 Claims, 4 Drawing Sheets

(56) References Cited

U.S. PATENT DOCUMENTS

| | | | | |
|---|---|---|---|---|
| 8,313,213 | B2 * | 11/2012 | Lin | F21V 19/004<br>362/217.12 |
| 2012/0106144 | A1 * | 5/2012 | Chang | F21K 9/17<br>362/218 |
| 2013/0088863 | A1 * | 4/2013 | Park | F21V 29/004<br>362/218 |

FOREIGN PATENT DOCUMENTS

| | | | |
|---|---|---|---|
| CN | 203036343 | U | 7/2013 |
| CN | 203068179 | U | 7/2013 |

* cited by examiner

LED LAMP WITH EXTERNAL LIGHT SOURCE

TECHNICAL FIELD OF THE INVENTION

This invention is related to a LED lamp, and particularly to an LED lamp with an external light source.

BACKGROUND

The fluorescent lamp includes mercury vapor sealed into a glass tube and a high voltage is applied thereto to generate arc light. This structure has not been changed since it was invented by GE Company in 1938.

Currently, along with the application of LED lamps, People seals LED light bars into a lamp tube to form a LED lamp in order to replace traditional fluorescent lamps. However, since the LED bars are placed inside of the lamp tube, on the one hand, the complex assembly of LED bars and lamp tube make it difficult to achieve automatic production and reduce the cost; on the other hand, waste heat generated by LED is difficult to dissipate, which decreases the service life and luminous efficiency.

SUMMARY OF THE INVENTION

The present invention solves the technical problems stated above by providing an LED lamp with an external light source, which can achieve automatic production and reduce manufacture cost, and the waste heat can be easily dissipated.

In order to achieve the objective stated above, the present invention provides: an LED lamp with an external light source, comprises a tube and an LED light source plate, the LED light source plate comprises a strip base and a plurality of LED illuminants installed on the snip base. The tube includes a strip through hole along the axial direction of the lamp. The strip base is fixed to the external circumference. surface, the plurality of the LED illuminants are placed between two side surfaces of the strip through hole.

Preferably, the tube is a circular glass tube, the strip through hole is on the top of the lamp. Because the circular glass tube has good transparency, which is benefit to transmit the light emitted by LED to outside. The strip through hole is installed on the top of the lamp to improve the product appearance. The inner surface of the circular glass lamp is covered with a diffusion layer to improve light emitting effect and make the light softer.

Preferably, each LED illuminants is installed on the external circumference surface of the tube. In this way, each LED illuminant is far away from the central axis of the tube and paths of light ray from each LED illuminant to the tube are increased. Furthermore, the whole inner surface of the tube can receive light emitted by the LED illuminant, which improves the effect of light mixing and further improves the uniformity of light emitted by the LED lamp.

Preferably, the width of the strip through hole is less than the width of the strip base, the width of the strip base is less than the diameter of the lamp. The ratio of the width of the strip base to the diameter of lamp ranges from 1/2 to 1/7.

Preferably, the width of the strip through hole ranges from 4.5 mm to 5.5 mm. The width of the strip base ranges from 8 mm to 12 mm.

Preferably, the strip base is fixed to the lamp with an adhesive agent, which makes it easy to achieve automatic production.

In one preferable embodiment, the tube thither includes connection planes installed on two sides of the external circumference surface of the strip through hole. The strip base is fixed to the connection plane with double side tapes. This connecting way is very simple.

In another preferable embodiment, the strip base is fixed to the lamp by adhering the strip base onto the external circumference surface of the lamp with at least one adhesive tape. This connecting way is also easy to achieve automatic production.

In other preferable embodiment, two laterals of the strip through hole are bent inward, and two protuberance is further formed on the external circumference surface of the tube to form two V-shape slots. The strip base is locked by the two V-shape slots to form a fixed connection with the tube. In this connection way, the width of the strip base ranges from 8 mm to 9 mm.

In this invention, the strip base of the LED light source plate is fixed to the external circumference surface of the lamp. A plurality of LED light sources are placed between the two side surfaces of the strip through hole. This structure is more convenient than the existing structure with LED light source plate sealed in the tube. The above structure of the present invention is beneficial for automatic production, reducing cost, dissipating waste heat generated by LED, extending the service life and increasing the luminous efficiency. Furthermore, the plurality of LED light sources are placed between the two side surfaces of the strip through hole, which is beneficial for illuminating light on the tube, increasing light emitting angle and improving the diffusion effect of the light.

DETAIL DESCRIPTION OF THE INVENTION

The detail description of the invention with drawing and embodiments will be described below.

Figure 1:
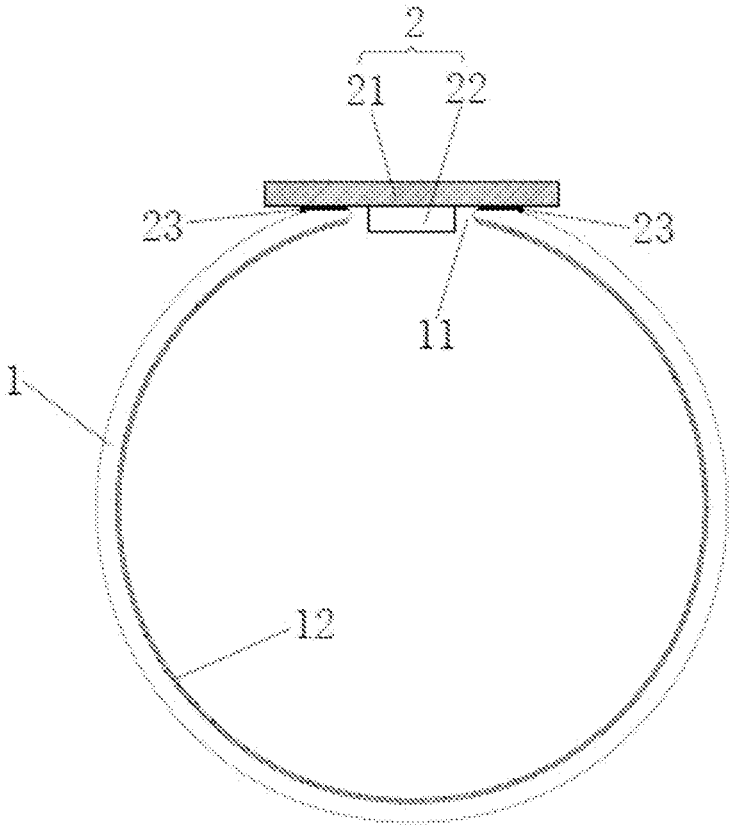
FIG. 1 is a cross section view of the first embodiment of the invention.

In the first embodiment, FIG. 1 shows an LED lamp with an external light source, which comprises a tube 1 and a LED light source plate 2. The LED light source plate 2 comprises a strip base 21 and a plurality of LED illuminants 22 uniformly installed on the strip base 21. The tube 1 has a strip through hole 11 along the axial direction of the tube 1 on the top of the tube 1. The strip base 21 is fixed to the external circumference surface of the strip through hole 11 by an adhesive agent 23, the plurality of LED illuminants 22 are located between the two side surfaces of the strip through hole 11. In this structure, each LED illuminant 22 is installed on the external circumference surface of the tube 1.

In this case, each LED illuminants 22 is far away from the central axis of the tube 1 and the paths of light ray from LED illuminants 22 to the tube 1 are increased. Furthermore, the whole inner surface of the tube 1 can receive light emitted by the LED illuminants 22, which improves the effect of light mixing and further improves the uniformity of light emitted by the LED lamp.

To further improve the light emitting of the LED lamp, preferably, the tube1 is a circular glass tube, and the inner surface of the circular glass tube is plated by a diffusion layer 12.

Preferably, the width of the strip through hole 11 is less than the width of the strip base 21, the width of the strip base 21 is less than a diameter of the tube 1. Preferably, the ratio of the width of the strip base 21 to the diameter of the tube 1 ranges from 1/2 to 1/7. In this case, the coordination and exterior quality of the LED lamp are improved.

Preferably, the width of the strip through hole 11 is 5 mm, the width of the strip base 21 is 12 mm, the outside diameter of the tube 1 is 24.8 mm. The strip base 21 is made of a PCB, which is convenient to make the LED light source plate 2 and reduces the manufacture cost.

Figure 2:
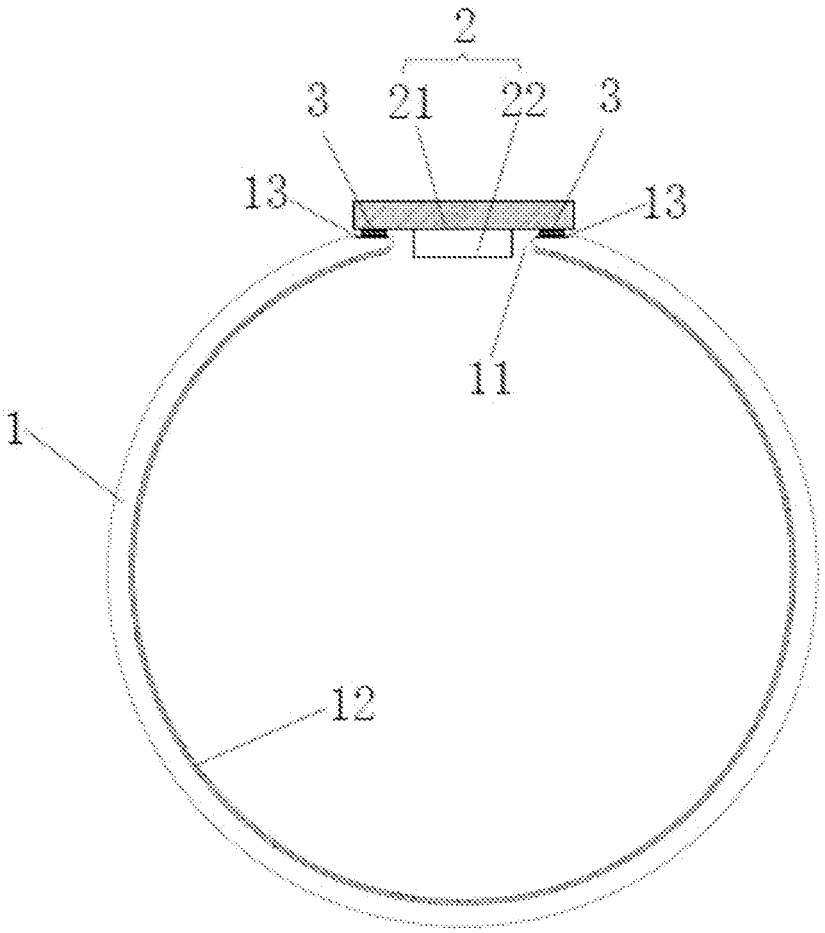
FIG. 2 is a cross section view of the second embodiment of the invention.

Regarding to the second embodiment which is shown in FIG. 2, the difference between the first embodiment and the second embodiment is that the tube 1 further includes two connection planes (i.e., two planar surfaces) 13 located respectively on two sides of the external circumference surface of the strip through hole 11. The strip base 21 is fixed to connection planes 13 with a double side tape 3. Preferably, the width of the strip base 21 is 8 mm.

Figure 3:
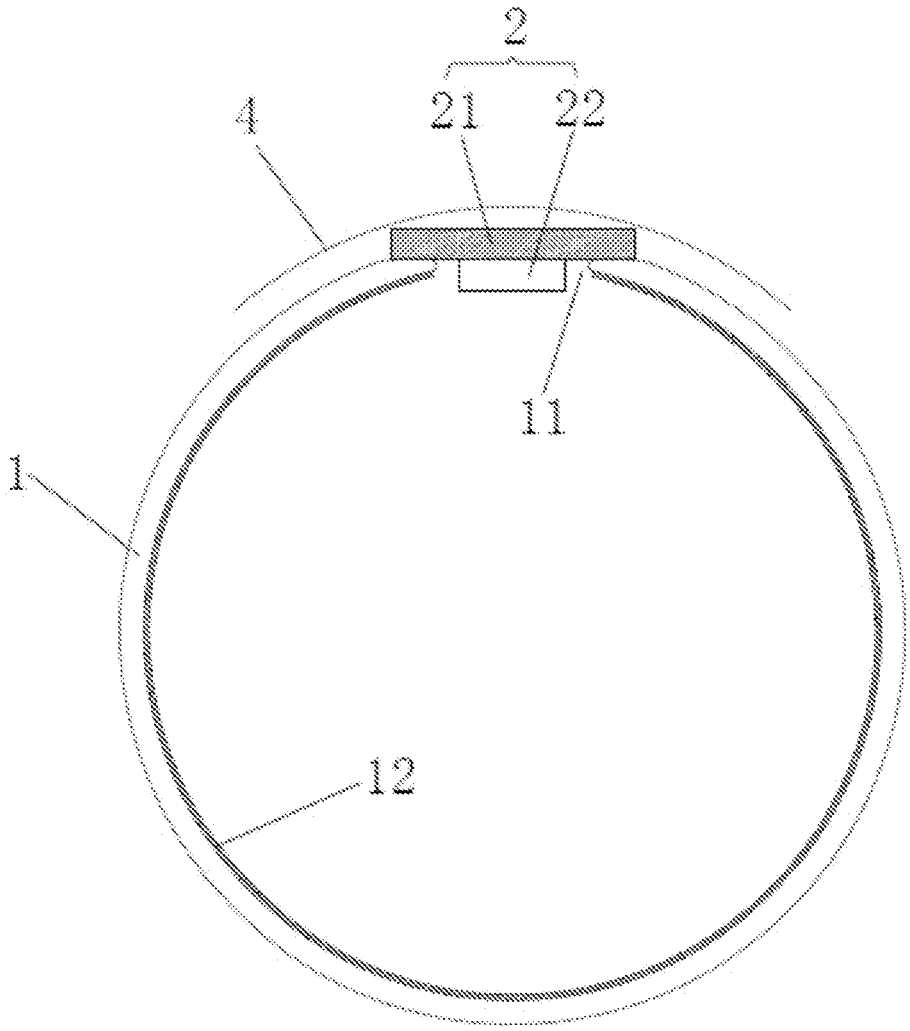
FIG. 3 is a cross section view of the third embodiment of the invention.

Regarding to the third embodiment which is shown in FIG. 3, the difference between the first embodiment and the third embodiment is that the strip base 21 is fixed on the external circumference surface of the tube 1 by a plurality of adhesive tapes 4. Preferably, the width of the strip base 21 is 8 mm.

Figure 4:
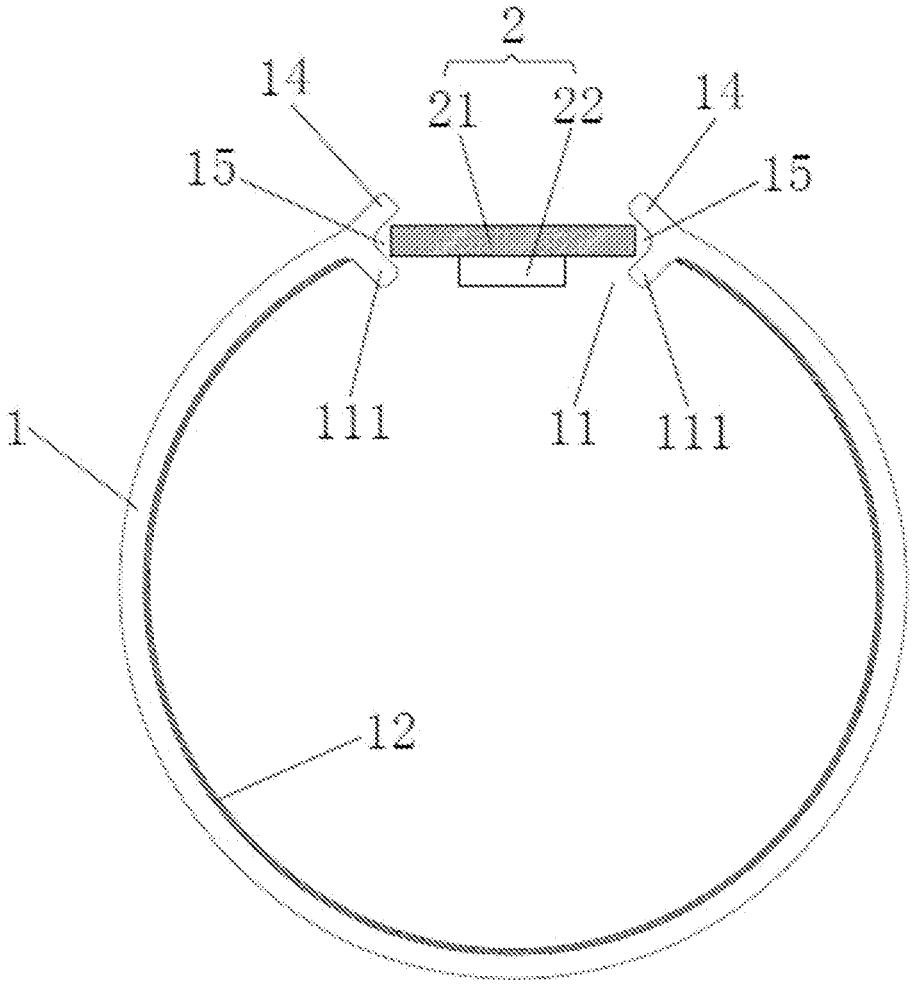
FIG. 4 is a cross section view of the fourth embodiment of the invention.

Regarding to the fourth embodiment which is shown in FIG. 4, the difference between the first embodiment and the fourth embodiment is that two laterals 111 of the strip through hole 11 are bent inward, and two protuberances 14 are further formed on the external circumference surface of the tube 1 to form two V-shape slots 15. The strip base 21 is locked by the two V-shape slots 15 to form a fixed connection with the tube 1. Preferably, the width of the strip base 21 is 8 mm, the width of the strip through hole 11 is 7.54 mm.

The above description is preferred embodiments of this invention. Various modifications to these embodiments are obvious to the person skilled in the art. The general principle defined therein may be implemented in other embodiments without departing from the spirit and scope of the application. Thus, the application is not limited to these embodiments illustrated herein, but conforms to a broadest scope consistent with the principle and novel features disclosed herein.

The invention claimed is:

1. An LED lamp with an external light source, comprising:

a tube and an LED light source plate;

wherein the LED light source plate comprises a strip base and a plurality of LED illuminants installed on the strip base, the tube defines a strip through hole along an axial direction of the tube, the strip base is fixed to an external circumference surface of the tube, the plurality of the LED illuminants are placed between two side surfaces of the strip through hole;

wherein the strip base has a first surface installed with the plurality of LED illuminants and a second surface opposite to the first surface, the first surface abuts with the external circumference surface of the tube, at least one adhesive tape is bonded onto the second surface and two ends of each of the at least one adhesive tape are stuck to the external circumference surface of the tube such that the strip base and the tube are fixed together and the strip base is located between the at least one adhesive tape and the external circumference surface of the tube.

2. The LED lamp of claim 1, wherein the tube is a circular glass tube, the strip through hole is on the top of the tube, a diffusion layer is located on the inner surface of the circular glass tube.

3. The LED lamp of claim 1, wherein each of the plurality of LED illuminants is located near to the external circumference surface of the tube.

4. The LED lamp of claim 1, wherein a width of the strip through hole is less than a width of the strip base, the width of the strip base is less than a diameter of the tube, a ratio of the width of the strip base to the diameter of the tube ranges from 1:2 to 1:7.

5. The LED lamp of claim 1, wherein a width of the strip through hole ranges from 4.5 mm to 5.5 mm, the width of the strip base ranges from 8 mm to 12 mm.

* * * * *